US011756724B2

(12) United States Patent
Yoon et al.

(10) Patent No.: US 11,756,724 B2
(45) Date of Patent: Sep. 12, 2023

(54) COIL ELECTRONIC COMPONENT

(71) Applicant: SAMSUNG ELECTRO-MECHANICS CO., LTD., Suwon-si (KR)

(72) Inventors: Chan Yoon, Suwon-si (KR); Dong Hwan Lee, Suwon-si (KR); Dong Jin Lee, Suwon-si (KR); Young Ghyu Ahn, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 916 days.

(21) Appl. No.: 16/586,537

(22) Filed: Sep. 27, 2019

(65) Prior Publication Data

US 2020/0185148 A1 Jun. 11, 2020

(30) Foreign Application Priority Data

Dec. 7, 2018 (KR) ..... 10-2018-0156895

(51) Int. Cl.
*H01F 27/32* (2006.01)
*H01F 27/28* (2006.01)
(Continued)

(52) U.S. Cl.
CPC ..... *H01F 27/327* (2013.01); *H01F 27/2804* (2013.01); *H01F 27/292* (2013.01); *H01F 41/10* (2013.01); *H01F 2027/2809* (2013.01)

(58) Field of Classification Search
CPC ..... H01F 2027/2809; H01F 27/292; H01F 27/2804; H01F 27/327
(Continued)

(56) References Cited

U.S. PATENT DOCUMENTS 9,490,062 B2 * 11/2016 Yoon ..... H01F 17/0013
10,854,383 B2 * 12/2020 Choi ..... H01F 27/292
(Continued)

FOREIGN PATENT DOCUMENTS

CN 110189886 B * 10/2021 ..... H01F 17/00
KR 10-2015-0019730 A 2/2015
(Continued)

OTHER PUBLICATIONS

Korean Office Action dated Apr. 1, 2023, issued in corresponding Korean Patent Application No. 10-2018-0156895.

*Primary Examiner* — Mang Tin Bik Lian
*Assistant Examiner* — Joselito S. Baisa
(74) *Attorney, Agent, or Firm* — Morgan, Lewis & Bockius LLP

(57) ABSTRACT

A coil electronic component includes a support substrate; first and second coil patterns disposed on an upper surface and a lower surface of the support substrate, respectively; an encapsulant covering at least portions of the support substrate and the first and second coil patterns; and first and second external electrodes connected to the first and second coil patterns, respectively, and disposed on portions of a lower surface of the encapsulant, wherein at least one portion of a lower surface of the first coil pattern is exposed from the encapsulant, at least one portion of a lower surface of the second coil pattern is exposed from the encapsulant, and the first and second external electrodes are respectively connected to the at least one portion of the lower surface of the first coil pattern and the at least one portion of the lower surface of the second coil pattern.

16 Claims, 8 Drawing Sheets

(51) Int. Cl.
*H01F 27/29* (2006.01)
*H01F 41/10* (2006.01)

(58) Field of Classification Search
USPC ..... 336/192
See application file for complete search history.

(56) References Cited

U.S. PATENT DOCUMENTS

| | | | | |
|---|---|---|---|---|
| 11,133,129 | B2 * | 9/2021 | Lee | H01F 17/04 |
| 2012/0274432 | A1 * | 11/2012 | Jeong | H01F 27/2804 336/192 |
| 2015/0048915 | A1 | 2/2015 | Yoon et al. | |
| 2016/0268038 | A1 * | 9/2016 | Choi | H01F 27/255 |
| 2017/0098997 | A1 * | 4/2017 | Hamada | H01F 1/0306 |
| 2017/0133146 | A1 * | 5/2017 | Lee | H01F 41/042 |
| 2017/0162319 | A1 * | 6/2017 | Otani | H01F 17/0013 |
| 2017/0169930 | A1 * | 6/2017 | Kudo | H01F 17/0013 |
| 2018/0096783 | A1 * | 4/2018 | Fukuda | H01F 27/366 |
| 2019/0189338 | A1 * | 6/2019 | Kim | H01F 17/04 |
| 2019/0362873 | A1 * | 11/2019 | Arai | H01F 27/24 |

FOREIGN PATENT DOCUMENTS

| | | | | |
|---|---|---|---|---|
| KR | 10-1548862 | B1 | | 8/2015 |
| KR | 20170085873 | A | * | 7/2017 |
| KR | 10-2017-0097882 | A | | 8/2017 |
| KR | 10-2017-0103422 | A | | 9/2017 |
| KR | 20180014593 | A1 | * | 2/2018 |
| KR | 10-2018-0116604 | A | | 10/2018 |

* cited by examiner

COIL ELECTRONIC COMPONENT

CROSS-REFERENCE TO RELATED APPLICATION(S)

This application claims the benefit of priority to Korean Patent Application No. 10-2018-0156895 filed on Dec. 7, 2018 in the Korean Intellectual Property Office, the entire disclosure of which is incorporated herein by reference.

TECHNICAL FIELD

The present disclosure relates to a coil electronic component.

BACKGROUND

With the miniaturization and thinning of electronic devices such as digital TVs, mobile phones, laptop PCs, and the like, coil electronic components used in such electronic devices are required to be made smaller and thinner. To satisfy these requirements, research and development of coil electronic components having various forms of wirings or thin films has been actively conducted.

A main issue according to the miniaturization and thinning of coil electronic components is to provide the same properties as conventional coil components, regardless of such miniaturization and thinning. In order to satisfy such demand, it is necessary to increase a proportion of a magnetic material in a core filled with the magnetic material. However, there is a limit to increase the proportion of a magnetic material due to the strength of an inductor body, a change in frequency characteristics caused by the insulation properties, or the like.

In the case of the coil electronic component, attempts have been made to further reduce a thickness of a chip depending on changes in complexity of a recent set, multifunctionality, slimness, and the like. Accordingly, in the art, a method for ensuring high performance and reliability, even with the trend for slimness of chips, is required.

SUMMARY

An aspect of the present disclosure is to optimize a connection structure between a coil pattern and an external electrode, and to implement a connection structure between a coil pattern and an external electrode in a bottom of an encapsulant without employment of a dummy pattern.

According to an aspect of the present disclosure, a coil electronic component includes a support substrate; a first coil pattern and a second coil pattern disposed on an upper surface and a lower surface of the support substrate, respectively, in a stacking direction; an encapsulant covering at least portions of the support substrate and the first and second coil patterns; and first and second external electrodes connected to the first and second coil patterns, respectively, and disposed on portions of a lower surface of the encapsulant in the stacking direction, wherein at least one portion of a lower surface of the first coil pattern in the stacking direction is exposed from the encapsulant, at least one portion of a lower surface of the second coil pattern in the stacking direction is exposed from the encapsulant, and the first and second external electrodes are respectively connected to the at least one portion of the lower surface of the first coil pattern and the at least one portion of the lower surface of the second coil pattern.

In an exemplary embodiment, each of the first and second external electrodes may have a shape extending from a respective one of exposed portions of the lower surfaces of the first and second coil patterns to the lower surface of the encapsulant in the stacking direction.

In an exemplary embodiment, a length of a region, extending from the exposed portion of the lower surface of the first external electrode to the lower surface of the encapsulant, may be greater than a length of a region, extending from the exposed portion of the lower surface of the second external electrode to the lower surface of the encapsulant.

In an exemplary embodiment, at least one of the first and second external electrodes may be disposed along a surface of a groove formed in the encapsulant.

In an exemplary embodiment, the groove may be open to the lower surface and a side surface of the encapsulant, and may be closed in directions of an upper surface and remaining side surfaces of the encapsulant.

In an exemplary embodiment, the groove may be open to the lower surface, two opposing side surfaces, and another side surface, connecting the two opposing side surfaces to each other, of the encapsulant, and may be closed in directions of an upper surface and remaining side surfaces of the encapsulant.

In an exemplary embodiment, the coil electronic component may further include first and second plated layers covering the first and second external electrodes, respectively.

In an exemplary embodiment, the first and second plated layers may be disposed along surfaces of the first and second external electrodes, respectively.

In an exemplary embodiment, each of the first and second external electrodes may include any one of copper (Cu), silver (Ag), nickel (Ni), aluminum (Al), or platinum (Pt).

In an exemplary embodiment, each of the first and second external electrodes may be a Cu electrode.

In an exemplary embodiment, the support substrate may include a groove having a shape in which a portion of the support substrate is removed to expose the lower surface of the first coil pattern.

In an exemplary embodiment, the first external electrode may be connected to the first coil pattern through a groove of the support substrate.

In an exemplary embodiment, exposed portions of the lower surfaces of the first and second coil patterns may be a curved surface.

According to another aspect of the present disclosure, a coil electronic component includes a support substrate; a first coil pattern and a second coil pattern disposed on an upper surface and a lower surface of the support substrate, respectively, in a stacking direction; an encapsulant covering at least portions of the support substrate and the first and second coil patterns; and first and second external electrodes connected to the first and second coil patterns, respectively, wherein the encapsulant includes first and second reduced-thickness portions on two opposing side surfaces of the encapsulant, respectively, in a length direction of the coil electronic component, a portion of a lower surface of the first coil pattern in the stacking direction is exposed from the encapsulant by the first reduced-thickness portion, a portion of a lower surface of the second coil pattern in the stacking direction is exposed from the encapsulant by the second reduced-thickness portion, and the first and second external electrodes are disposed on exposed portions of the lower surfaces of the first and second coil patterns, respectively.

In an exemplary embodiment, each of the first and second external electrodes may have a shape extending from a respective one of the exposed portions of the lower surfaces of the first and second coil patterns to a lower surface of the encapsulant in the stacking direction.

In an exemplary embodiment, a length of the first external electrode in the stacking direction is greater than a length of the second external electrode in the stacking direction.

Other features and aspects will be apparent from the following detailed description, the drawings, and the claims.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
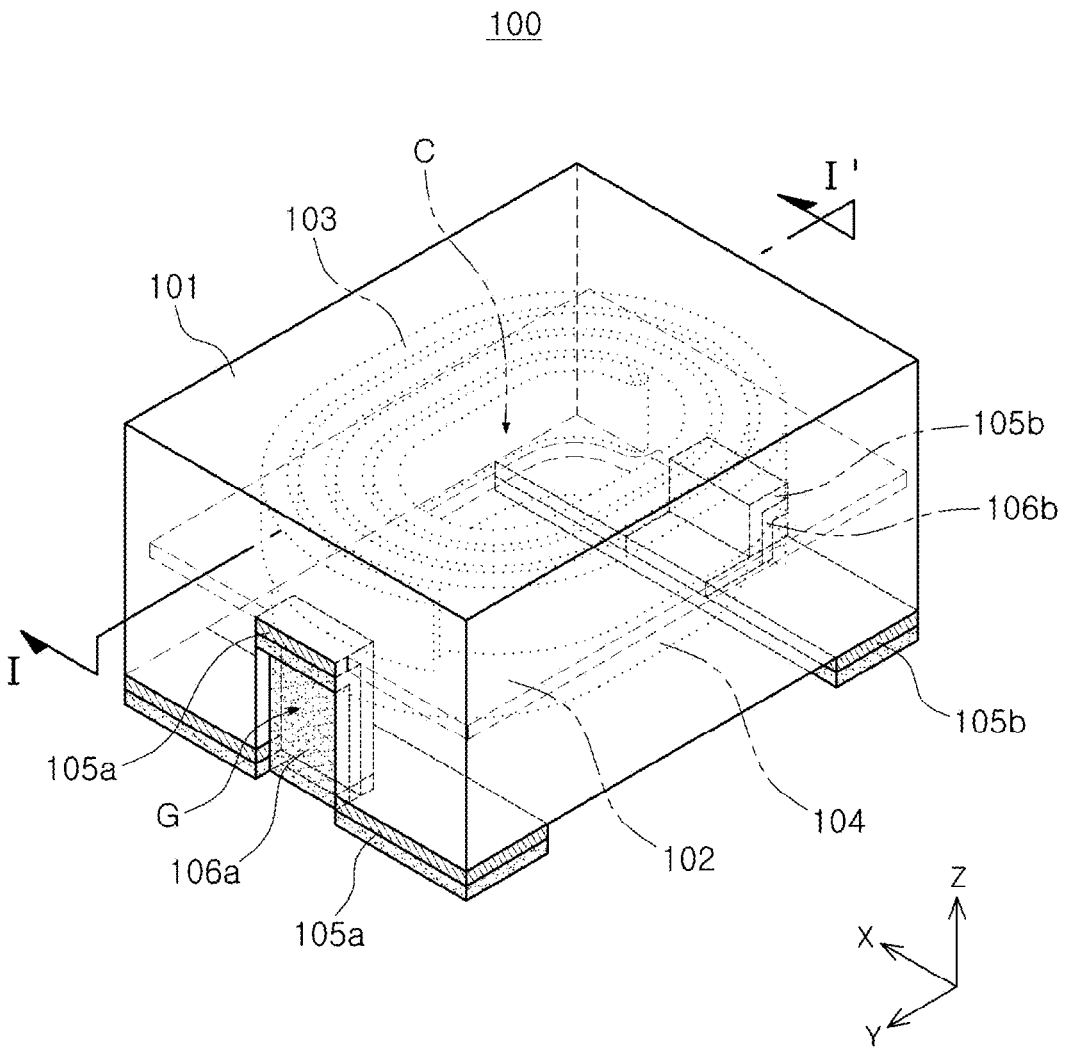
FIG. 1 is a schematic transmission perspective view illustrating a coil electronic component according to an exemplary embodiment of the present disclosure.

Hereinafter, exemplary embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, exemplary embodiments of the present disclosure will be described with reference to schematic views. In the drawings, for example, due to manufacturing techniques and/or tolerances, modifications of the shape shown may be estimated. Thus, exemplary embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

The present invention relates to a ceramic electronic component, and an electronic component including a ceramic material may be capacitors, inductors, piezoelectric elements, varistors, thermistors, or the like. A multilayer ceramic capacitor as an example of a ceramic electronic component will be described below.

Figure 2:
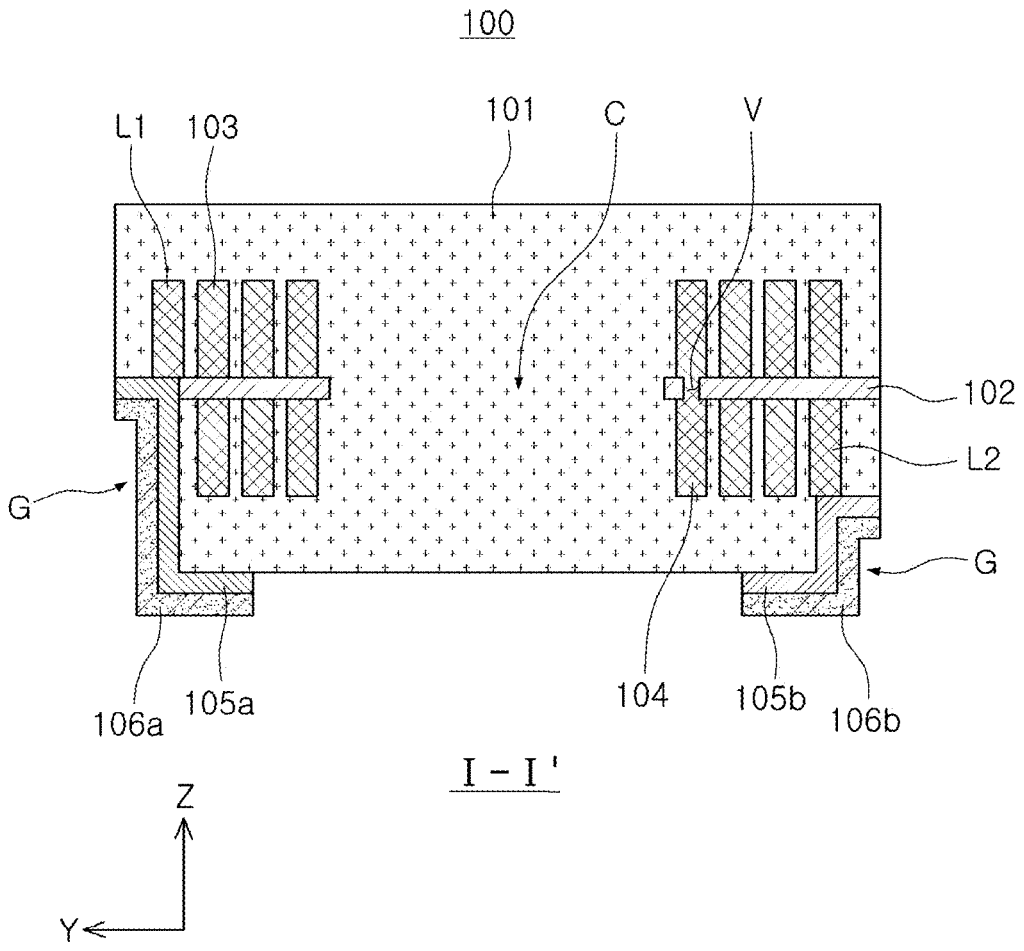
FIG. 2 is a cross-sectional view taken along line I-I' of FIG. 1.
Figure 3:
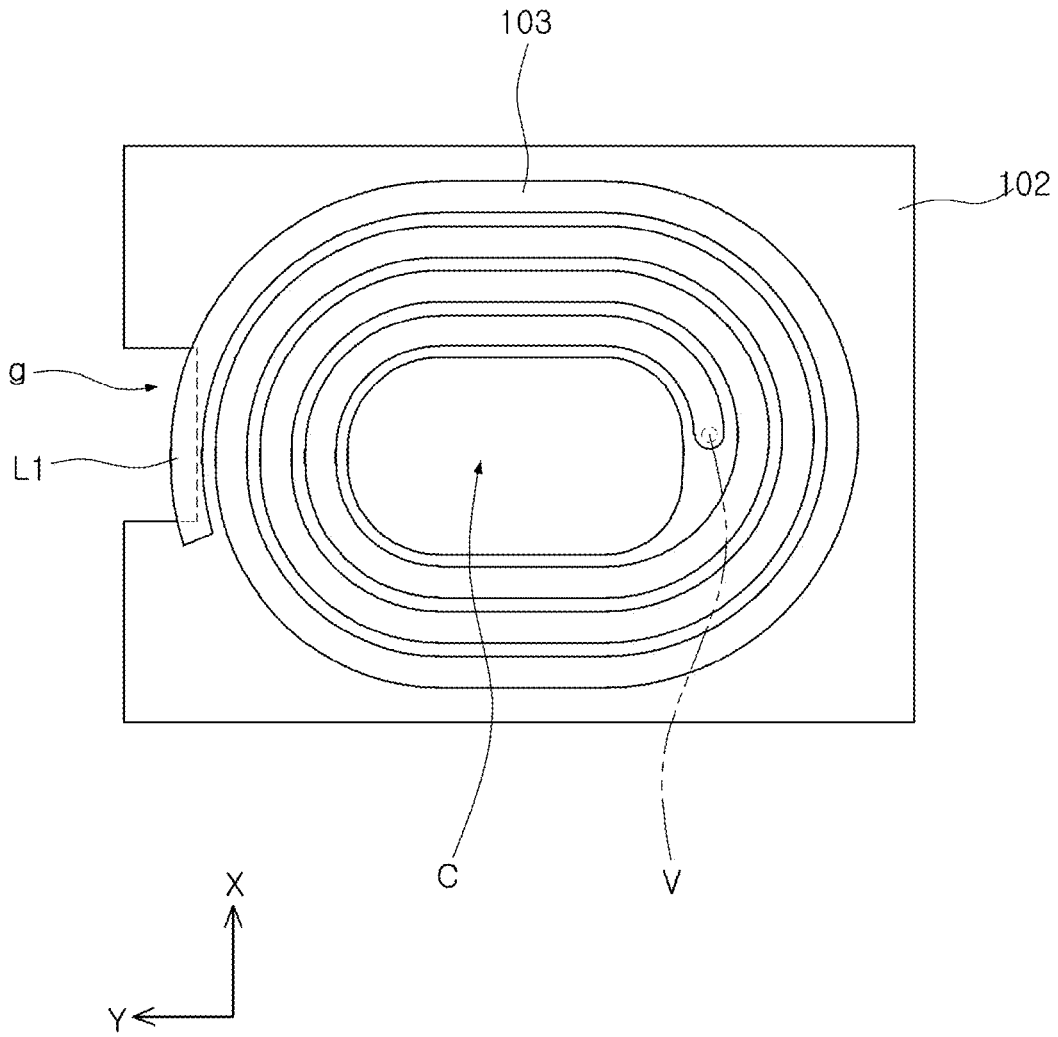
FIG. 3 is a schematic plan view of a first coil pattern viewed from above.
Figure 4:
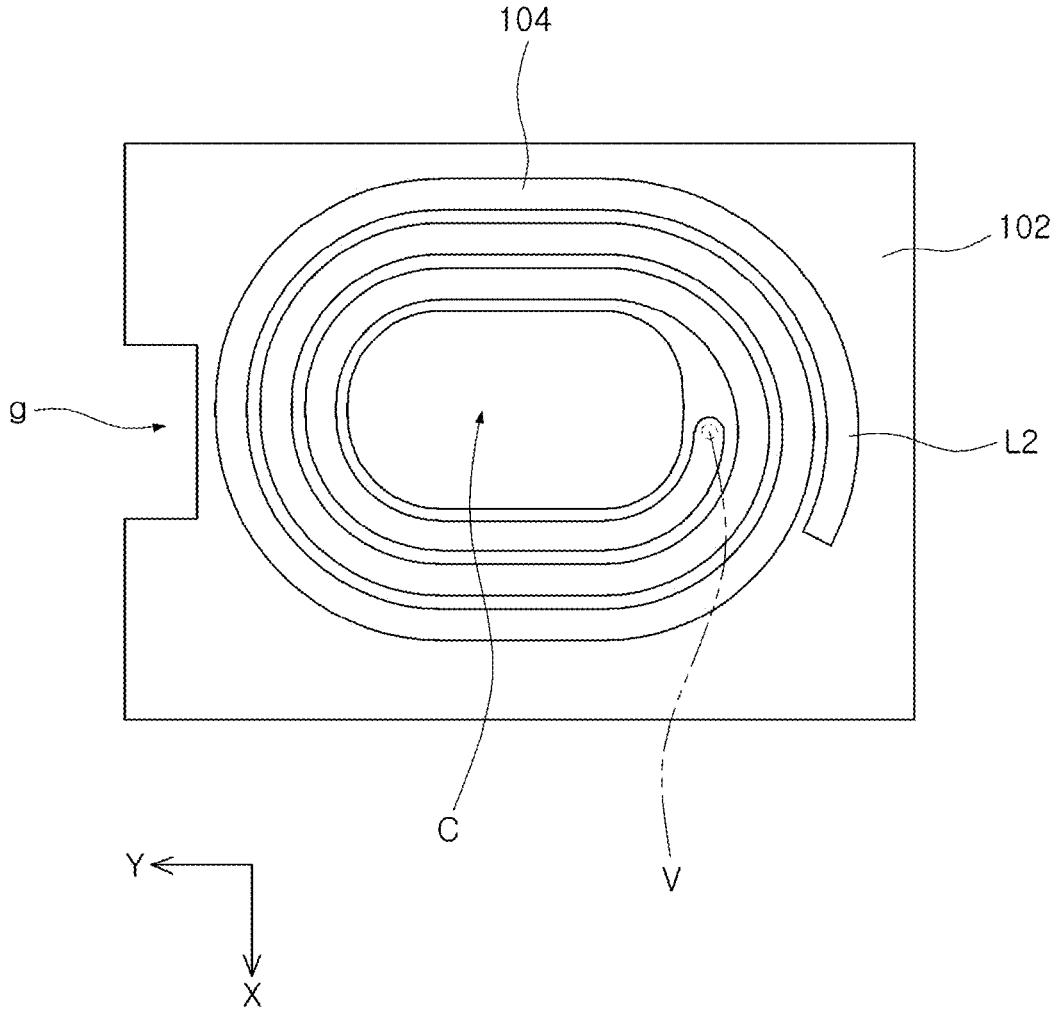
FIG. 4 is a schematic plan view of a second coil pattern viewed from below.
Figure 5:
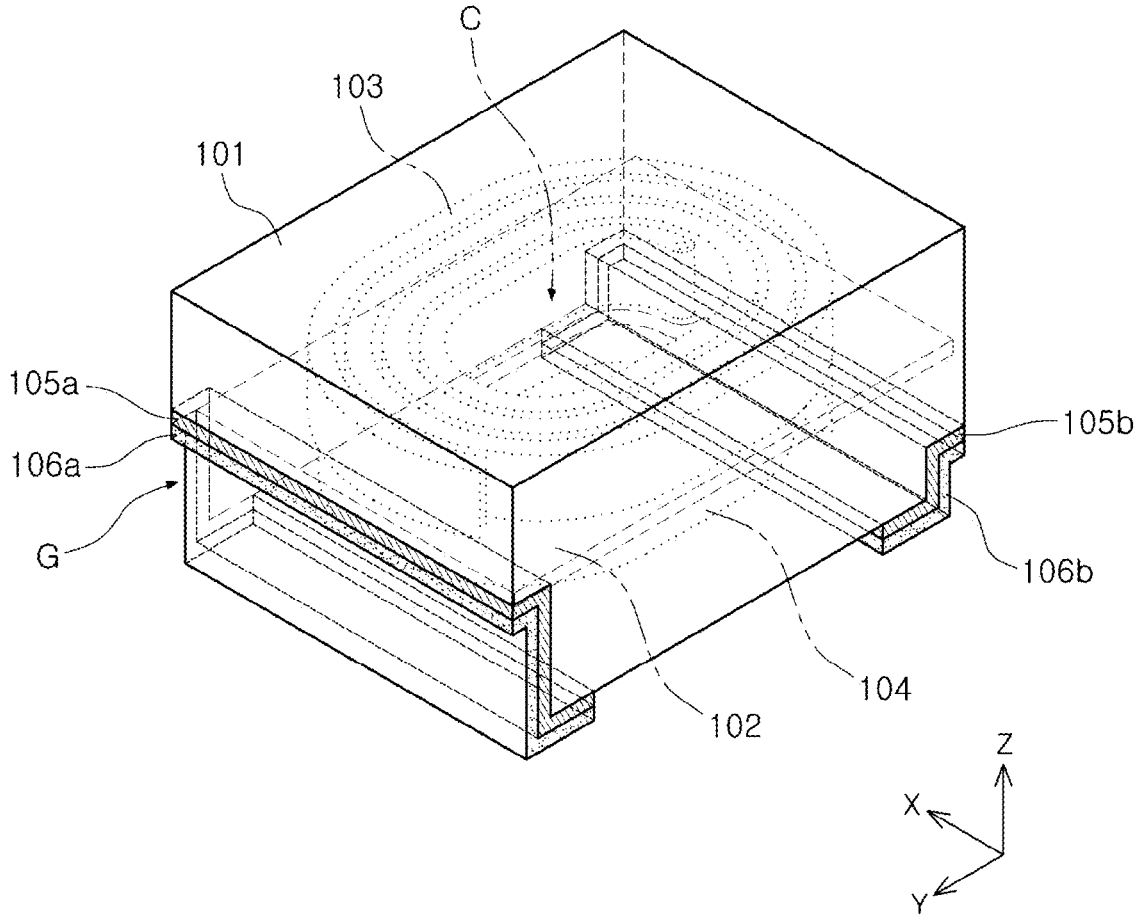
FIG. 5 is a schematic transmission perspective view illustrating a coil electronic component according to a modified embodiment of the present disclosure.

FIG. 1 is a schematic transmission perspective view illustrating a coil electronic component according to an exemplary embodiment of the present disclosure. FIG. 2 is a cross-sectional view taken along line I-I' of FIG. 1. Moreover, FIG. 3 is a schematic plan view of a first coil pattern viewed from above, and FIG. 4 is a schematic plan view of a second coil pattern viewed from below. FIG. 5 is a schematic transmission perspective view illustrating a coil electronic component according to a modified embodiment of the present disclosure.

Referring to FIGS. 1 to 5, a coil electronic component 100 according to exemplary embodiments of the present disclosure includes a support substrate 102, first and second coil patterns 103 and 104, an encapsulant 101, and first and second external electrodes 105*a* and 105*b*. Here, lower surfaces of the first and second coil patterns 103 and 104 have a shape exposed to the encapsulant 101 and connected to each of the first and second external electrodes 105*a* and 105*b*.

The encapsulant 101 may form an appearance of a coil electronic component 100 while sealing at least portions of the support substrate 102 and the first coil pattern 103. The encapsulant 101 may include magnetic particles, and an insulating resin may be interposed between the magnetic particles. Moreover, an insulating film may be coated on a surface of the magnetic particles. The magnetic particles, which may be included in the encapsulant 101, may be ferrite, metal, or the like. In the case of the metal, the magnetic particles may be formed of an iron (Fe)-based alloy, or the like, by way of example. In detail, the magnetic particles may be formed of a nanocrystalline-based alloy composed of Fe—Si—B—Cr, a Fe—Ni-based alloy, or the like. As described above, when the magnetic particles are formed of the Fe-based alloy, magnetic properties such as magnetic permeability are excellent, but there may be more vulnerability to an electrostatic discharge (ESD). Thus, an additional insulating structure may be interposed between the coil pattern 103 and the magnetic particles.

As illustrated in the drawings, the encapsulant 101 may have a groove G having a shape in which a portion is removed, so lower surfaces of the first and second coil patterns 103 and 104 may be exposed. The groove G may be a reduced-thickness portion of the encapsulant 101 in a length direction of the encapsulant 101 (e.g., a Y direction). Here, the groove G may be formed to be open to a lower surface and a side surface of the encapsulant 101 and closed to an upper surface and the remaining side surfaces. In addition, the first and second external electrodes 105*a* and 105*b* may be formed along a surface of the groove G formed in the encapsulant 101. As the first and second coil patterns 103 and 104 and the external electrodes 105*a* and 105*b* are connected using the groove G of the encapsulant 101, an effective and stable electrical connection structure may be implemented.

A shape of the groove G of the encapsulant 101 may have a structure the same as that of a modified example of FIG. 5. In the case of a modified example of FIG. 5, a shape of a groove of the encapsulant and a shape of the external electrode are different from those of the embodiment of FIG. 1, and the descriptions of the remaining components according to the embodiment of FIG. 1 can be applied to the modified example of FIG. 5. Referring to FIG. 5, a groove G may be open to a lower surface, two opposing side surfaces, and another side surface, connecting the two opposing side surfaces to each other, of the encapsulant 101, and may be closed in directions of an upper surface and the remaining side surfaces of the encapsulant 101. Here, both side surfaces of the encapsulant 101, opposing each other, may be provided in a width direction of the encapsulant 101 (e.g., an X direction based on FIG. 5). Moreover, as illustrated in the drawing, the first and second external electrodes 105*a* and 105*b* may be formed along a surface of the groove G of the encapsulant 101. The groove G having a shape in which both side surfaces are open, as described above, may be obtained during a dicing process in which the encapsulant 101 is individualized into a unit of a component. In a range in which the encapsulant 101 is not completely penetrated, the encapsulant 101 is partially diced to form the groove G. Then, full dicing is performed to form the encapsulant 101 in a unit of an individual component.

The support substrate 102 may be provided as a polypropylene glycol (PPG) substrate, a ferrite substrate, a metal-based soft magnetic substrate, or the like. A central portion of the support substrate 102 is penetrated to form a through-hole, and the through-hole is filled with the encapsulant 101 to form a core portion C. Moreover, as illustrated in the drawings, the support substrate 102 may include the groove g having a shape in which a portion is removed to expose a lower surface of the first coil pattern 103. In this case, the first external electrode 105*a* may be connected to the first coil pattern 103 through the groove g of the support substrate 102. Here, the groove g may be formed to have a shape which is open to an upper surface, a lower surface, and a side surface of the support substrate 102, and which is closed to the remaining side surfaces.

The first coil pattern 103 is disposed in an upper surface of the support substrate 102, while the second coil pattern 104 is disposed in a lower surface of the support substrate 102 in a stacking direction (e.g., a Z direction). The first and second coil patterns 103 and 104 may have a spiral structure forming one or more turns, and may be connected to each other by a via V passing through the support substrate 102. The first and second coil patterns 103 and 104 may be formed using a plating process used in the art, such as pattern plating, anisotropic plating, isotropic plating, or the like, and may be formed to have a multilayer structure using a plurality of processes among those processes described above.

According to an exemplary embodiment of the present disclosure, the first and second coil patterns 103 and 104 are connected to the first and second external electrodes 105*a* and 105*b* through lower surfaces of the first and second coil patterns. Here, the first and second coil patterns 103 and 104 have lead-out patterns L1 and L2, corresponding to regions connected to the first and second external electrodes 105*a* and 105*b*, respectively, and the lead-out patterns L1 and L2 may be disposed at the outermost portions of the first and second coil patterns 103 and 104. When it is required for stability of the electrical connection structure, the lead-out patterns L1 and L2 may be formed to have widths greater than those of the remaining regions of the first and second coil patterns 103 and 104. As described above, according to an exemplary embodiment of the present disclosure, in a coil electronic component having a bottom electrode structure, a lower surface of the first coil pattern 103, disposed in an upper surface of the support substrate 102, and the first external electrode 105*a* are directly connected to each other, and a separate dummy pattern for connection with the first external electrode 105*a* is not employed in a lower surface of the support substrate 102. Since such a dummy pattern is not provided, a size of a core portion C and the number of turns of the first and second coil patterns 103 and 104 may be increased, and thus a performance of the coil electronic component 100 may also be improved. In other words, a performance degradation, which may occur when a dummy pattern for connection of the first external electrode 105*a* and the first coil pattern 103 is employed, may be prevented.

The first and second external electrodes 105*a* and 105*b* are disposed in at least a lower surface outside the encapsulant 101, and may be connected to the first and second coil patterns 103 and 104, respectively, as described above. In the case of the coil electronic component 100 having a bottom electrode structure as described above, a spacing distance between adjacent components is reduced, so mounting density may be high when a coil electronic component is mounted on a substrate. Each of first and second external electrodes 105*a* and 105*b* may have a shape extended from each of exposed lower surfaces of the first and second coil patterns 103 and 104 to a lower surface of the encapsulant 101. In this case, a length of a region extended to the lower surface of the encapsulant 101 of the first external electrode 105*a* may be longer than that of the second external electrode 105*b*.

As described above, the first and second external electrodes 105*a* and 105*b* may be formed along a surface of the groove G formed in the encapsulant 101, and a side surface may be exposed from the encapsulant 101. The first and second external electrodes 105*a* and 105*b* may be a sputtering electrode. In this case, the sputtering electrode may be a copper (Cu) electrode. Here, other metallic materials such as silver (Ag), nickel (Ni), aluminum (Al), platinum (Pt), or the like, in addition to the Cu electrode, may be used, and, other processes such as conductive paste applying, plating, or the like, in addition to sputtering, may be used, to form the first and second external electrodes 105*a* and 105*b*. Moreover, in addition to the first and second external electrodes 105*a* and 105*b*, an additional external electrode may be provided, for example, a third external electrode between the first and second external electrodes 105*a* and 105*b*.

The first and second plated layers 106*a* and 106*b* may be formed to cover the first and second external electrodes 105*a* and 105*b*, respectively. The first and second plated layers 106*a* and 106*b* may include a component such as Ni, tin (Sn), or the like, in order to improve mountability of the coil electronic component 100, and may be implemented in a multilayer structure. As illustrated in the drawing, the first and second plated layers 106*a* and 106*b* may be formed along surfaces of the first and second external electrodes 105*a* and 105*b*, that is, to follow surfaces of the first and second external electrodes 105*a* and 105*b*. In this case, the groove G of the encapsulant 101 may not be completely filled with the first and second plated layers 106*a* and 106*b*.

As described above, in the coil electronic component 100 according to an exemplary embodiment of the present disclosure, lower surfaces of the first and second coil patterns 103 and 104 are exposed from the encapsulant 101, and the first and second external electrodes 105*a* and 105*b* are formed to be connected to the exposed surfaces, so the first and second external electrodes 105*a* and 105*b* may have an symmetric structure. Accordingly, a connection structure between the first and second coil patterns 103 and 104 and the first and second external electrodes 105*a* and 105*b* may be effectively obtained without a dummy pattern, and performance degradation of the coil electronic component 100 which may occur when a dummy pattern is used may be prevented.

Hereinafter, a method of manufacturing a coil electronic component of the above-described shape will be described with reference to FIGS. 6 to 10, and a method of implementing a connection structure between a coil pattern and an external electrode will be mainly described.

Figure 6:
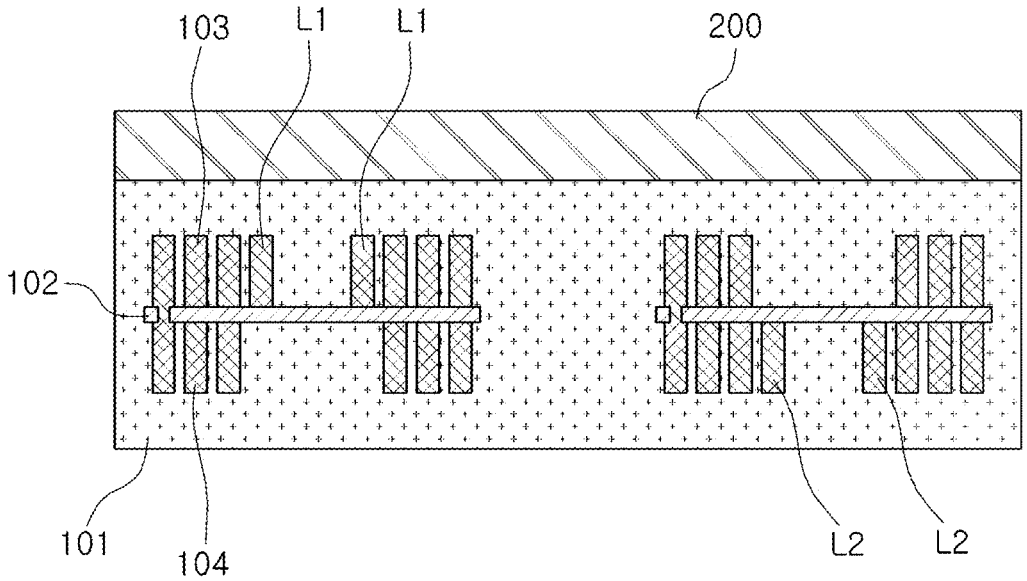
FIGS. 6 to 10 illustrate an example of a method of manufacturing a coil electronic product according to an exemplary embodiment of the present disclosure.

First, as illustrated in FIG. 6, a body structure of a coil electronic component, that is, a structure in which the coil patterns 103 and 104 are provided inside the encapsulant 101 is provided, and the body structure is attached to a carrier film 200 for a subsequent process. As an example of a process, the coil patterns 103 and 104 may be obtained by plating a metal such as Cu or the like in the support substrate 102. The encapsulant 101 is provided in a multilayer film form, and the encapsulant may be obtained through stacking in upper and lower portions of the coil patterns 103 and 104, pressing, and heating processes.

Figure 7:
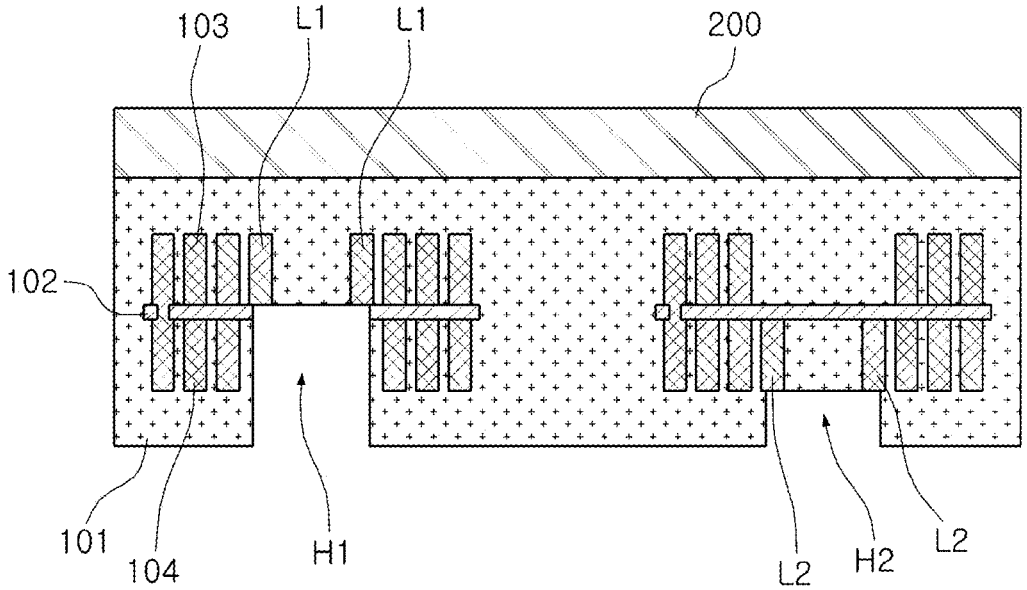

Next, as illustrated in FIG. 7, a portion of the encapsulant 101 is removed to expose a lead-out pattern L1 of the first coil pattern 103 to form an open region H1. In a similar manner, a portion of the encapsulant 101 is removed to expose a lead-out pattern L2 of the second coil pattern 104) to form an open region H2. A method of forming the open regions H1 and H2 in the encapsulant 101 may be a suitable etching processes used in the art such as mechanical processing using a blade, laser processing, or the like. The open regions H1 and H2 of the encapsulant 101 may have a shape of a groove in which a side surface is closed. In this case, a groove G, having a shape the same as that of FIG. 1, may be formed in the encapsulant 101 through a subsequent dicing process. Moreover, the open regions H1 and H2 of the encapsulant 101 may have a shape which is open to both side surfaces, opposing each other, through partial dicing. In this case, through subsequent full dicing, a groove G, having a shape the same as that of FIG. 5, may be formed in the encapsulant 101.

Figure 8:
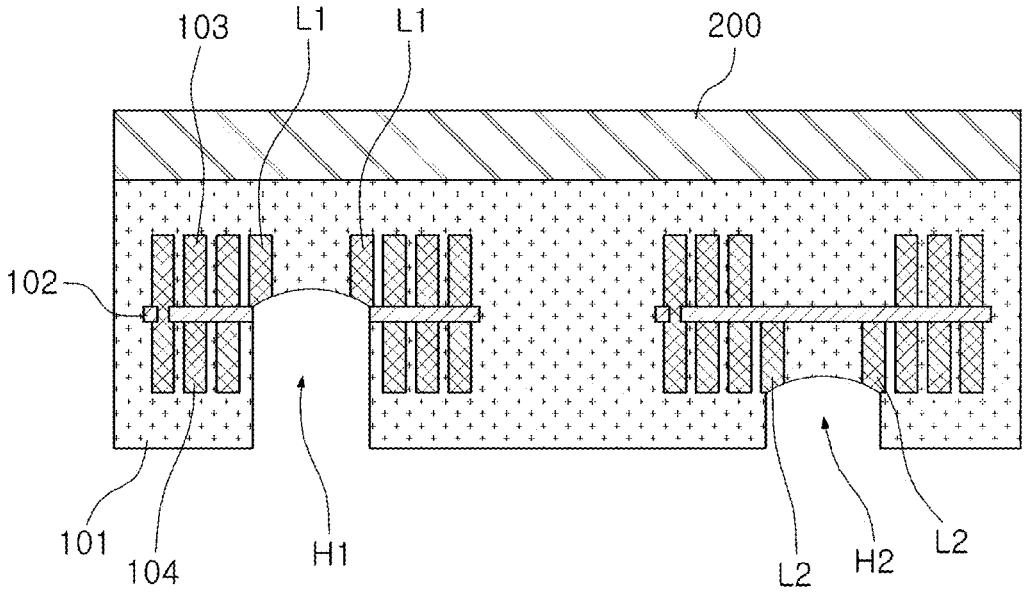

Meanwhile, when the first coil pattern 103 is exposed, a portion of the support substrate 102 together with a portion of the encapsulant 101 may be removed. Moreover, through the process described above, portions of the first and second coil patterns 103 and 104 may also be removed. In this case, as illustrated in FIG. 8, the exposed lower surfaces of the first and second coil patterns 103 and 104 may be formed to be curved surfaces.

Figure 9:
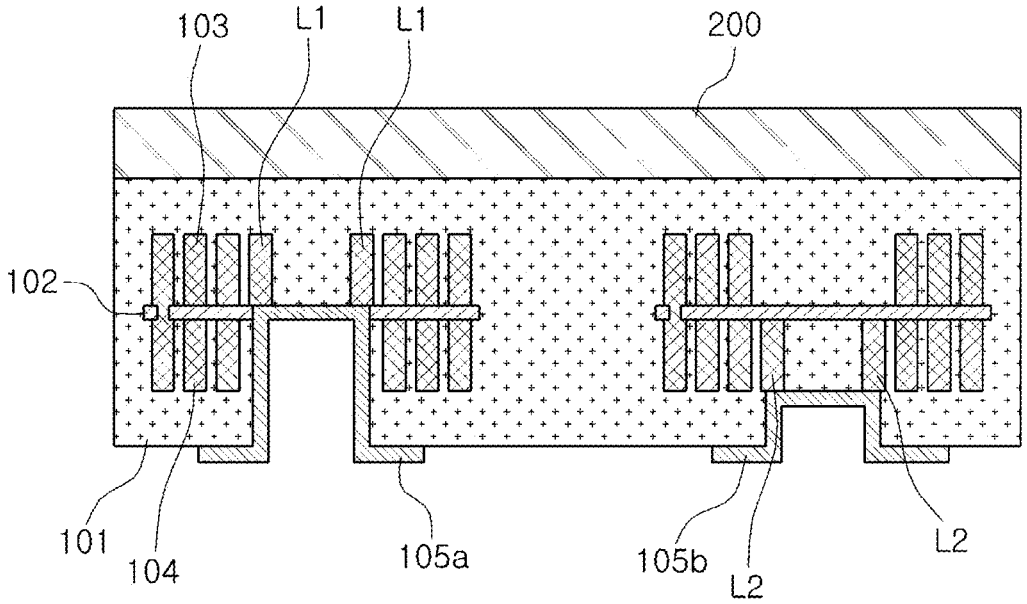

Next, as illustrated in FIG. 9, first and second external electrodes 105*a* and 105*b* are formed to be connected to the exposed lower surfaces of the first and second coil patterns 103 and 104, more particularly, exposed lower surfaces of the lead-out patterns L1 and L2. The first and second external electrodes 105*a* and 105*b* may be formed using, for example, a sputtering process, and an example of a specific material may be a Cu electrode. The sputtering process may be suitable for implementing an intended shape of the external electrodes 105*a* and 105*b* to be stably combined with the coil patterns 103 and 104, if widths of the open regions H1 and H2 are narrow.

Figure 10:
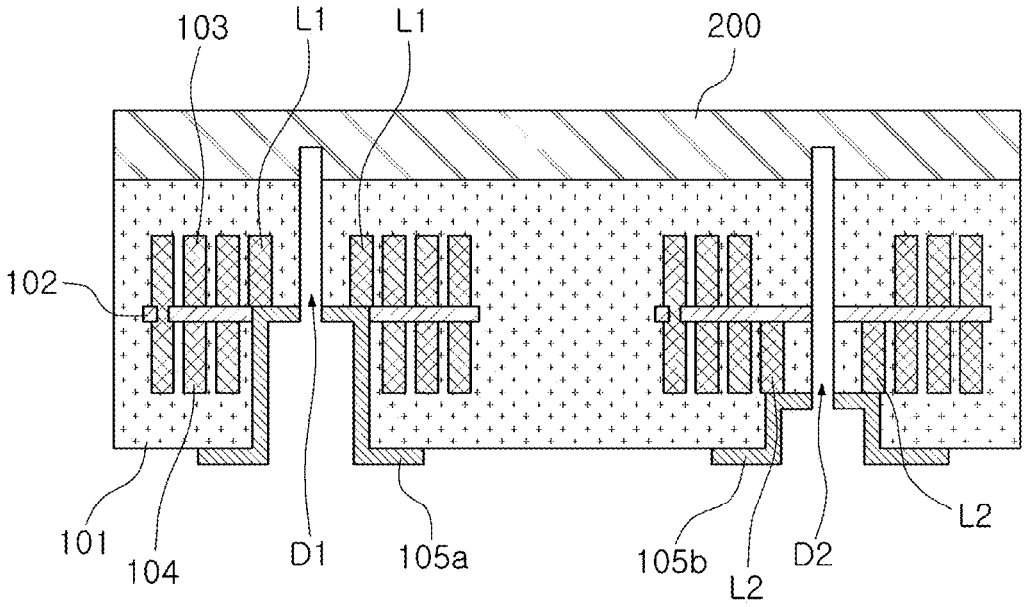

Next, as illustrated in FIG. 10, in order to be separated into an individual component unit, dicing lines D1 and D2 are formed. Thus, side surfaces of the first and second external electrodes 105*a* and 105*b* may be exposed to a side surface of the encapsulant 101. The dicing process may be performed by mechanical processing using a blade, laser processing, or the like. Then, the carrier film 200 is separated to allow a body to be completely separated into individual component units. Then, the first and second plated layers 106*a* and 106*b* may be formed on surfaces of the first and second external electrodes 105*a* and 105*b*, respectively. Here, the first and second plated layers 106*a* and 106*b* may be formed before dicing is performed.

As set forth above, according to an exemplary embodiment of the present disclosure, a thickness of a sintered electrode layer including a conductive metal and glass, of an external electrode, is controlled by position, so moisture resistance characteristics can be improved and reliability can be improved.

While exemplary embodiments have been shown and described above, it will be apparent to those skilled in the art that modifications and variations could be made without departing from the scope of the present invention as defined by the appended claims.

What is claimed is:

1. A coil electronic component, comprising:

a support substrate;

a first coil pattern and a second coil pattern disposed on an upper surface and a lower surface of the support substrate, respectively, in a stacking direction;

an encapsulant covering at least portions of the support substrate and the first and second coil patterns; and first and second external electrodes connected to the first and second coil patterns, respectively, and disposed on portions of a lower surface of the encapsulant in the stacking direction, wherein at least one portion of a lower surface of the first coil pattern in the stacking direction is exposed from the encapsulant, at least one portion of a lower surface of the second coil pattern in the stacking direction is exposed from the encapsulant, the first and second external electrodes are respectively connected to the at least one portion of the lower surface of the first coil pattern and the at least one portion of the lower surface of the second coil pattern, the first coil pattern and the first external electrode are connected to each other at a level higher than a lower surface of the support substrate, and the first and second external electrodes cover the lower surface of the encapsulant.

2. The coil electronic component of claim 1, wherein each of the first and second external electrodes has a shape extending from a respective one of exposed portions of the lower surfaces of the first and second coil patterns to the lower surface of the encapsulant in the stacking direction.

3. The coil electronic component of claim 2, wherein a length of a region of the first external electrode, extending from the exposed portion of the lower surface of the first coil pattern to the lower surface of the encapsulant, is greater than a length of a region of the second external electrode, extending from the exposed portion of the lower surface of the second coil pattern to the lower surface of the encapsulant.

4. The coil electronic component of claim 1, wherein at least one of the first and second external electrodes is disposed along a surface of a groove formed in the encapsulant.

5. The coil electronic component of claim 4, wherein the groove is open to the lower surface and a side surface of the encapsulant, and is closed in directions of an upper surface and remaining side surfaces of the encapsulant.

6. The coil electronic component of claim 4, wherein the groove is open to the lower surface, two opposing side surfaces, and another side surface, connecting the two opposing side surfaces to each other, of the encapsulant, and is closed in directions of an upper surface and remaining side surfaces of the encapsulant.

7. The coil electronic component of claim 1, further comprising first and second plated layers covering the first and second external electrodes, respectively.

8. The coil electronic component of claim 7, wherein the first and second plated layers are disposed along surfaces of the first and second external electrodes, respectively.

9. The coil electronic component of claim 1, wherein each of the first and second external electrodes includes any one of copper (Cu), silver (Ag), nickel (Ni), aluminum (Al), or platinum (Pt).

10. The coil electronic component of claim 1, wherein each of the first and second external electrodes is a copper (Cu) electrode.

11. The coil electronic component of claim 1, wherein the support substrate includes a groove having a shape in which a portion of the support substrate is removed to expose the lower surface of the first coil pattern.

12. The coil electronic component of claim 11, wherein the first external electrode is connected to the first coil pattern through the groove of the support substrate.

13. The coil electronic component of claim 1, wherein exposed portions of the lower surfaces of the first and second coil patterns are a curved surface.

14. A coil electronic component, comprising:

a support substrate;

a first coil pattern and a second coil pattern disposed on an upper surface and a lower surface of the support substrate, respectively, in a stacking direction;

an encapsulant covering at least portions of the support substrate and the first and second coil patterns; and first and second external electrodes connected to the first and second coil patterns, respectively, wherein the encapsulant includes first and second reduced-thickness portions on two opposing side surfaces of the encapsulant, respectively, in a length direction of the coil electronic component, a portion of a lower surface of the first coil pattern in the stacking direction is exposed from the encapsulant by the first reduced-thickness portion, a portion of a lower surface of the second coil pattern in the stacking direction is exposed from the encapsulant by the second reduced-thickness portion, the first and second external electrodes are disposed on exposed portions of the lower surfaces of the first and second coil patterns, respectively, and in the length direction, a first step is formed between an outermost surface of the first external electrode and an outer surface of a portion of the first external electrode extending along the first reduced-thickness portion of the encapsulant, and a second step is formed between an outermost surface of the second external electrode and an outer surface of a portion of the second external electrode extending along the second reduced-thickness portion of the encapsulant.

15. The coil electronic component of claim 14, wherein each of the first and second external electrodes has a shape extending from a respective one of the exposed portions of the lower surfaces of the first and second coil patterns to a lower surface of the encapsulant in the stacking direction.

16. The coil electronic component of claim 14, wherein a length of the first external electrode in the stacking direction is greater than a length of the second external electrode in the stacking direction.

* * * * *